US007358937B2

(12) United States Patent
Suzuki

(10) Patent No.: US 7,358,937 B2
(45) Date of Patent: Apr. 15, 2008

(54) DISPLAY APPARATUS AND DISPLAY READING APPARATUS

(75) Inventor: Yoshio Suzuki, Kanagawa (JP)

(73) Assignee: Sony Corporation (JP)

( * ) Notice: Subject to any disclaimer, the term of this patent is extended or adjusted under 35 U.S.C. 154(b) by 778 days.

(21) Appl. No.: 10/870,004

(22) Filed: Jun. 18, 2004

(65) Prior Publication Data

US 2005/0012697 A1 Jan. 20, 2005

(30) Foreign Application Priority Data

Jul. 16, 2003 (JP) ..... P2003-275069

(51) Int. Cl.
*G09G 3/30* (2006.01)

(52) U.S. Cl. ..... 345/76; 345/82

(58) Field of Classification Search ..... 345/82, 345/83, 76–80, 204, 205; 315/169.1, 169.3
See application file for complete search history.

(56) References Cited

U.S. PATENT DOCUMENTS

2003/0230750 A1* 12/2003 Koyama et al. ..... 257/72
2005/0057580 A1* 3/2005 Yamano et al. ..... 345/690
2005/0151705 A1* 7/2005 Fish ..... 345/76
2005/0168491 A1* 8/2005 Takahara et al. ..... 345/690
2005/0180083 A1* 8/2005 Takahara et al. ..... 361/152

FOREIGN PATENT DOCUMENTS

JP 2002-189445 7/2002

* cited by examiner

*Primary Examiner*—Richard Osorio
(74) *Attorney, Agent, or Firm*—Rader Fishman & Grauer PLLC; Ronald P. Kananen

(57) ABSTRACT

In a display apparatus having organic EL devices to display images in units of pixels, each pixel comprises a first transistor to drive the relevant device; a current supply circuit for supplying, in a first mode, a current of a magnitude based on the value of the pixel displayed by the device; a second transistor whose control electrode is connected to the control electrode of the first transistor to thereby constitute a current mirror circuit, wherein the second transistor receives, in the first mode, the current from the current supply circuit; a capacitor connected to the control electrode of the second transistor and holding, in the first mode, the voltage generated in the control electrode of the second transistor when the current from the current supply circuit has been received; and a switch for connecting, in a second mode, the device to the first transistor in a state where the voltage generated in the control electrode of the second transistor and held in the capacitor is supplied to the control electrode of the first transistor. In this device, high-quality image display can be achieved at lower cost with a simplified structure.

3 Claims, 16 Drawing Sheets

FIG. 2

IN CURRENT PROGRAMMING MODE

| SWITCH | A | B | C |
|---|---|---|---|
| STATE | ON | ON | OFF |

FIG. 3

IN LIGHT EMITTING MODE

| SWITCH | A | B | C |
|---|---|---|---|
| STATE | OFF | OFF | ON |

FIG. 9

IN LIGHT EMITTING MODE

| SWITCH | SW11 | SW12 | SW13 | SW14 |
|---|---|---|---|---|
| STATE | OFF | ON | OFF | ON |

FIG. 10

IN LIGHT RECEIVING MODE

| SWITCH | SW11 | SW12 | SW13 | SW14 |
|---|---|---|---|---|
| STATE | ON | OFF | ON | OFF |

FIG. 12

IN CURRENT PROGRAMMING MODE

| SWITCH | SW21 | SW22 | SW23 | SW24 | SW25 |
|---|---|---|---|---|---|
| STATE | ON | ON | OFF | OFF | OFF |

FIG. 13

IN LIGHT EMITTING MODE

| SWITCH | SW21 | SW22 | SW23 | SW24 | SW25 |
|---|---|---|---|---|---|
| STATE | OFF | OFF | ON | OFF | OFF |

FIG. 14

IN LIGHT RECEIVING MODE

| SWITCH | SW21 | SW22 | SW23 | SW24 | SW25 |
|---|---|---|---|---|---|
| STATE | OFF | OFF | OFF | ON | ON |

FIG. 15

IN READING MODE

| SWITCH | SW21 | SW22 | SW23 | SW24 | SW25 |
|---|---|---|---|---|---|
| STATE | ON | ON | OFF | ON | ON |

FIG. 17

IN CURRENT PROGRAMMING MODE

| SWITCH | SW31 | SW32 | SW33 | SW34 | SW35 |
|---|---|---|---|---|---|
| STATE | ON | ON | OFF | OFF | OFF |

FIG. 18

IN LIGHT EMITTING MODE

| SWITCH | SW31 | SW32 | SW33 | SW34 | SW35 |
|---|---|---|---|---|---|
| STATE | OFF | OFF | ON | OFF | OFF |

FIG. 19

IN LIGHT RECEIVING MODE

| SWITCH | SW31 | SW32 | SW33 | SW34 | SW35 |
|---|---|---|---|---|---|
| STATE | OFF | OFF | OFF | ON | ON |

FIG. 20

IN READING MODE

| SWITCH | SW31 | SW32 | SW33 | SW34 | SW35 |
|---|---|---|---|---|---|
| STATE | ON | ON | OFF | ON | ON |

DISPLAY APPARATUS AND DISPLAY READING APPARATUS

BACKGROUND OF THE INVENTION

The present invention relates to a display apparatus and a display reading apparatus capable of displaying high-quality images and reading such images at lower cost.

Recently, organic EL (Electro Luminescent) devices are attracting attention as components employed to constitute a display apparatus. In general, a TFT (Thin Film Transistor) is used for driving an organic EL device, but a problem arises of deterioration in the image quality when controlling the driving of the TFT by "voltage", due to large variations in the characteristics (particularly the threshold voltage Vth) of the TFT.

In order to reduce such variations, a current programming method (as disclosed in, e.g., cited Patent Document 1) is proposed which controls driving of the TFT by "current" that causes less harmful influence derived from the transmission path.

Referring to FIGS. 1 through 3, an explanation will be given below on a method of driving an organic EL device according to a current program. FIG. 1 is a schematic diagram showing a circuit 1 to control light emission of an organic EL device by a current program. In the circuit 1, a capacitor 13 and a source (S) terminal of a driving transistor (TFT) 12 are connected to a source line 18. The capacitor 13 is connected to a gate (G) terminal of the driving transistor 12 while being connected to a model current source 14 via a switch A. A drain (D) terminal of the driving transistor 12 is connected to the model current source 14 via a switch B, and an organic EL device 11 is connected to the drain (D) terminal of the driving transistor 12 via a switch C.

According to the current program in the circuit 1, the switches A to C are set as shown in FIG. 2, so that a predetermined model current I1 obtained from the model current source 14 is caused to flow in the circuit 1. Then the current I1 flows in the driving transistor 12 to thereby generate, at the gate thereof, a gate voltage corresponding to the current I1. And the gate voltage thus generated is charged in the capacitor 13. The current program is executed in this manner.

Meanwhile, in the case of activating the organic EL device 11 for emission of light according to the current program, the switches A to C are so set as shown in FIG. 3. In this case, the model current source 14 is disconnected from the circuit 1, and the driving transistor 12 causes a flow of the current I1, which corresponds to the voltage charged in the capacitor 13, into the organic EL device 11. As a result, the organic EL device 11 is activated to emit light therefrom.

The switches A to C shown in FIG. 1 may be replaced with switching transistors as well. FIG. 4 shows another example of forming the circuit 1 by replacement of the switches A to C in FIG. 1 with switching transistors 25 to 27.

Thus, it is possible to generate a predetermined current and to activate the organic EL device to emit light at an intensity corresponding to the current.

Patent Document 1:

Japanese Patent Laid-open No. 2002-189445

However, for constituting a display apparatus of a high image quality, it is necessary to cause a flow of a minute current in the organic EL device. According to the technology disclosed in the above Patent Document 1, a problem exists where a minute current fails to be programmed accurately and rapidly. Further, another problem exists where, in enabling the organic EL device to read the image by receiving the light, another driving circuit needs to be provided separately from the aforementioned driving circuit used to display the image, hence increasing the production cost.

SUMMARY OF THE INVENTION

The present invention has been accomplished in view of the circumstances mentioned above. It is an object of the invention to achieve high quality display of images and also to realize such display and reading thereof at lower cost.

According to one aspect of the present invention, a display apparatus is provided having luminescent devices to display images in units of pixels, wherein each pixel comprises a first transistor to drive the relevant device; a current circuit for supplying, in a first mode, a current of a magnitude based on the value of the pixel displayed by the device; a second transistor whose control electrode is connected to the control electrode of the first transistor to thereby constitute a current mirror circuit in combination with the first transistor, wherein the second transistor receives, in the first mode, the current from the current supply circuit; a capacitor connected to the control electrode of the second transistor and holding, in the first mode, the voltage generated in the control electrode of the second transistor in a state where the current from the current supply circuit is received; and a switch for connecting, in a second mode, the device to the first transistor in a state where the voltage generated in the control electrode of the second transistor and held in the capacitor is supplied to the control electrode of the first transistor.

In the display apparatus of the present invention, in the first mode, the current of a magnitude based on the value of the pixel displayed by the device is supplied to the second transistor, and the voltage generated in the control electrode of the second transistor in response to the supplied current is held in the capacitor; and in the second mode, the device is connected to the first transistor which constitutes a current mirror circuit in combination with the second transistor in a state where the voltage generated in the control electrode of the second transistor and held in the capacitor is supplied to the control electrode of the second transistor.

According to another aspect of the present invention, a first display reading apparatus is provided having luminescent devices to display or read images in units of pixels, wherein each pixel comprises a first transistor to drive the relevant device; a current supply circuit for supplying, in a first mode, a current of a magnitude based on the value of the pixel displayed by the device; a second transistor whose control electrode is connected to the control electrode of the first transistor to thereby constitute a current mirror circuit in combination with the first transistor, wherein the second transistor receives, in the first mode, the current from the current supply circuit; a capacitor connected to the control electrode of the second transistor and holding, in the first mode, the voltage generated in the control electrode of the second transistor in a state where the current from the current supply circuit is received; a first switch changed when enabling the device to receive light; a second switch for connecting, in a second mode, the device to the first transistor in a state where the voltage generated in the control electrode of the second transistor and held in the capacitor is supplied to the control electrode of the first transistor; a third switch changed in a third mode for holding, in the capacitor, the voltage generated in the control electrode of the first transistor in a state where the current to flow in the device is supplied; and a fourth switch for outputting, in a fourth mode, the current to flow in the second transistor in a state where the voltage generated in the control electrode of the first transistor and held in the capacitor is supplied to the control electrode of the second transistor.

In the first mode, a light emitting current program is executed to activate the device for emission of light; in the second mode, an image is displayed by activating the device for emission of light; in the third mode, a received light current program is executed on the basis of the light received by the device; and in the fourth mode, the current based on the received light is read out to thereby read the image.

The device may consist of a light emitting device to emit light in the second mode, and a light receiving device to receive the light in the third mode. The pixel may further comprise an amplifier circuit to amplify the current generated by the light receiving device.

In the first display reading apparatus of the present invention, in the first mode, the voltage generated in the control electrode of the second transistor is held in the capacitor in a state where the current is supplied from the current supply circuit; in the second mode, the device is connected to the first transistor in a state where the voltage generated in the control electrode of the second transistor and held in the capacitor is supplied to the control electrode of the first transistor; in the third mode, the voltage generated in the control electrode of the first transistor is held in the capacitor in a state where the current to flow in the device is supplied; and in the fourth mode, the current to flow in the second transistor is outputted in a state where the voltage generated in the control electrode of the first transistor and held in the capacitor is supplied to the control electrode of the second transistor.

According to a further aspect of the present invention, a second display reading apparatus is provided having luminescent devices to display or read images in units of pixels, wherein each pixel comprises a first transistor to drive the relevant device; a second transistor whose control electrode is connected to the control electrode of the first transistor to thereby constitute a current mirror circuit in combination with the first transistor; a capacitor connected to the control electrode of the first transistor and the control electrode of the second transistor; a first switch for connecting, in a first mode, the output electrode of the second transistor to the control electrode in such a manner that the voltage generated in the control electrode of the second transistor is held in the capacitor when a current of a magnitude based on the value of the pixel has been supplied; a second switch for connecting, in a second mode, the output electrode of the first transistor to the control electrode in such a manner that the voltage generated in the control electrode of the first transistor is held in the capacitor when the current has been supplied from the device; and a third switch for selectively changing the connection of the device to the first transistor in the first and second modes.

In the second display reading apparatus of the present invention, in the first mode, the output electrode of the second transistor is connected to the control electrode so that the voltage generated in the control electrode of the second transistor is held in the capacitor when the current of a magnitude based on the value of the pixel has been supplied; and in the second mode, the output electrode of the first transistor is connected to the control electrode in such a manner that the voltage generated in the control electrode of the first transistor is held in the capacitor when the current has been supplied from the device; and in the first and second modes, the connection of the device to the first transistor is selectively changed.

The present invention is capable of displaying images more simply and at lower cost while realizing a higher quality in displaying the images. Further, in addition to mere display, remarkable improvements are achievable also in the image reader with a simpler structure and at lower cost.

Regarding some preferred embodiments of the present invention to be explained below, the relationship of mutual correspondence between the structural requisites of the invention in this specification and the concrete examples in the embodiments of the invention is such that this description confirms that any concrete example supporting the invention is stated in connection with the relevant embodiment of the invention. Therefore, if there is any concrete example stated in connection with the embodiment but not described correspondingly to the structural requisite, it does not signify that the relevant concrete example is not corresponding to the structural requisite. To the contrary, if the concrete example is described herein correspondingly to the structural requisite, it does not signify either that the relevant concrete example is not corresponding to any other structural requisite.

Further, the following description does not signify that the whole inventions corresponding to the concrete examples mentioned in connection with the preferred embodiments are claimed entirely. In other words, the following description signifies the inventions corresponding to the concrete examples represented by the preferred embodiments, and the existence of any invention not claimed in this application does not negate the existence of some other invention that may be applied in the future as a division or may be added by amendment.

The above and other features and advantages of the present invention will become apparent from the following description which will be given with reference to the illustrative accompanying drawings.

BRIEF DESCRIPTION OF THE DRAWINGS

FIG. 2 is a diagram showing how each of switches is set in executing the current program in the circuit of FIG. 1;

FIG. 3 is a diagram showing how each of the switches is set in activating the device for emission of light in the circuit of FIG. 1;

FIG. 9 is a diagram showing how each of the switches is set in activating the device for emission of light in the circuit of FIG. 8;

FIG. 10 is a diagram showing how each of the switches is set in enabling the device to receive the light in the circuit of FIG. 8;

FIG. 12 is a diagram showing how each of the switches is set in the circuit of FIG. 11 to execute a current program in a display mode;

FIG. 13 is a diagram showing how each of the switches is set in the circuit of FIG. 11 to activate the device for emission of light in the display mode;

FIG. 14 is a diagram showing how each of the switches is set in the circuit of FIG. 11 to enable the device to receive the light in a read mode;

FIG. 15 is a diagram showing how each of the switches is set in the circuit of FIG. 11 to read out the current in the read mode;

FIG. 17 is a diagram showing how each of the switches is set in executing a current program in the display mode in the circuit of FIG. 16;

FIG. 18 is a diagram showing how each of the switches is set to activate the device for emission of light in the display mode in the circuit of FIG. 16;

FIG. 19 is a diagram showing how each of the switches is set to enable the device to receive the light in the read mode in the circuit of FIG. 16; and FIG. 20 is a diagram showing how each of the switches is set to read out the current in the read mode in the circuit of FIG. 16.

DETAILED DESCRIPTION OF THE PREFERRED EMBODIMENTS

Figure 1:
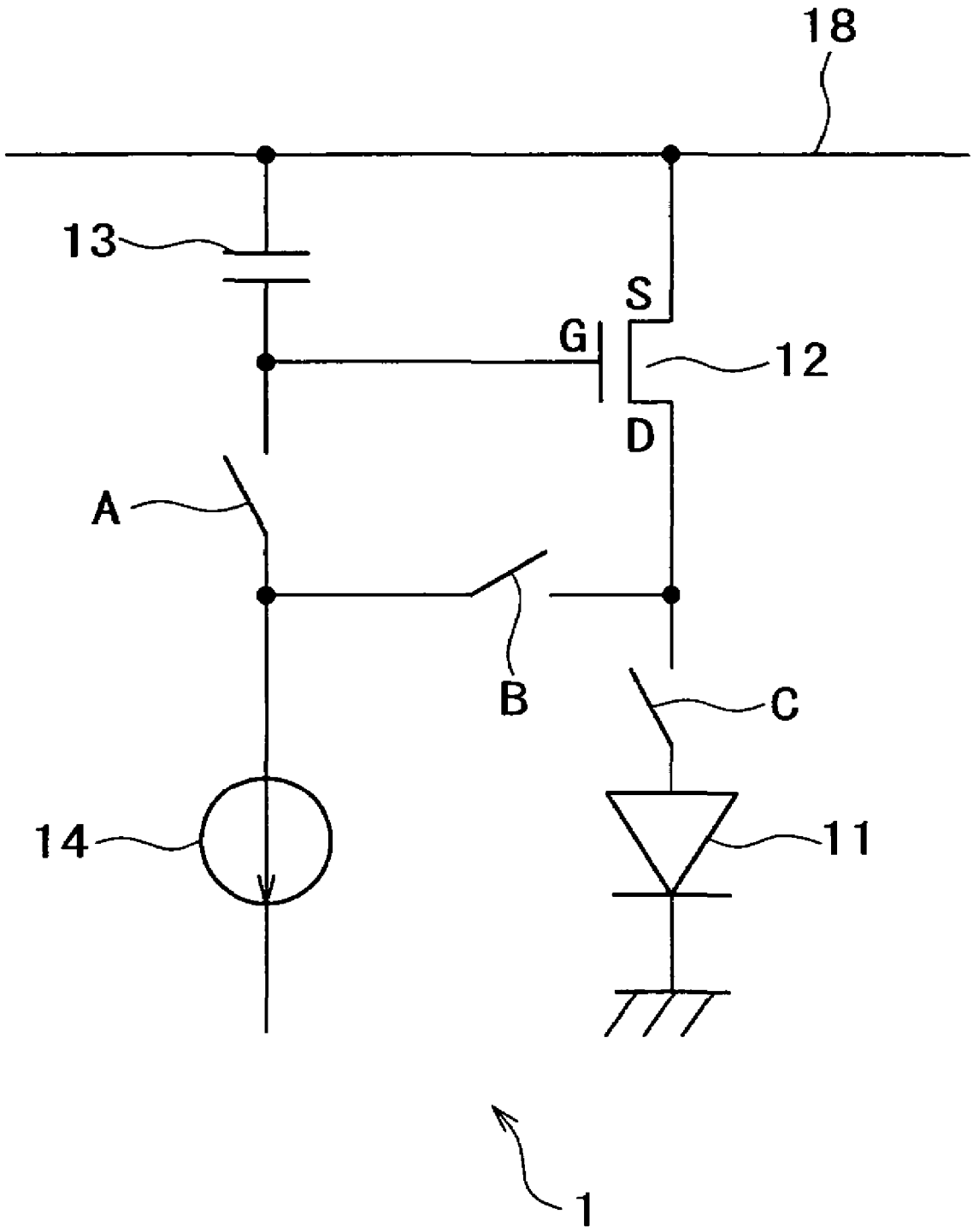
FIG. 1 is a circuit diagram showing the structure of a circuit to activate a luminescent device by a current program method.
Figure 4:
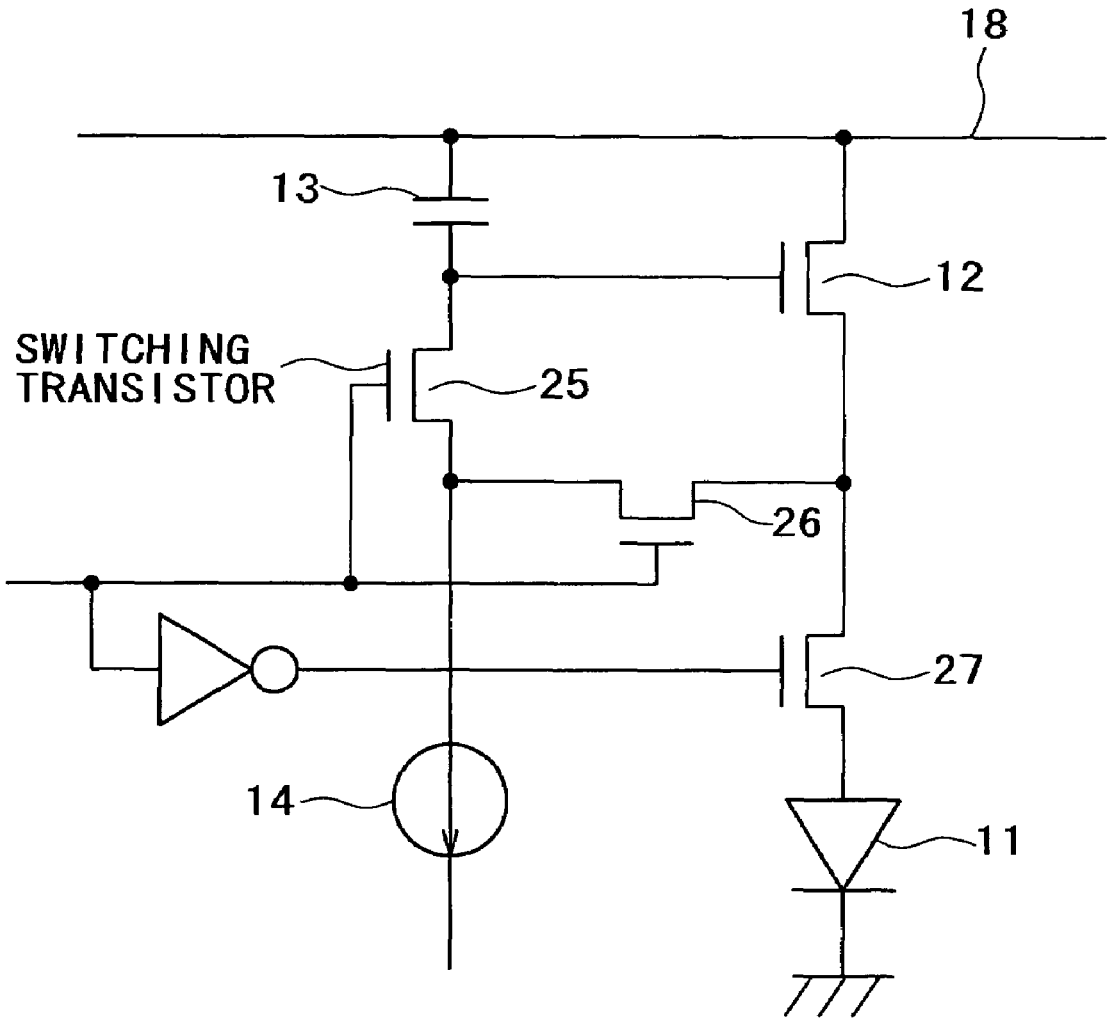
FIG. 4 is a circuit diagram showing another structural example of the circuit in FIG. 1.

An exemplary embodiment of the present invention represents a display apparatus (e.g., image display reading apparatus 40 in FIG. 5) having devices (e.g., organic EL device 101 in FIGS. 6A and 6B) to perform a display of images in units of pixels. Each pixel comprises a first transistor (e.g., transistor 92 in FIG. 6) to drive the device; a current circuit (e.g., constant current source IP in FIGS. 6A and 6B) for supplying, in a first mode (e.g., program mode), a current of a magnitude based on the value of the pixel displayed by the device; a second transistor (e.g., transistor 91 in FIGS. 6A and 6B) whose control electrode (e.g., gate) is connected to the control electrode of the first transistor to thereby constitute a current mirror circuit in combination with the first transistor, wherein the second transistor receives, in the first mode, the current supplied from the current circuit; a capacitor (e.g., capacitor 93 in FIGS. 6A and 6B) connected to the control electrode of the second transistor and holding, in the first mode, the voltage generated in the control electrode of the second transistor in a state where the current is supplied from the current circuit; and a switch (e.g., switch SW2 in FIGS. 6A and 6B) for connecting, in a second mode (e.g., light emitting mode), the device to the first transistor in a state where the voltage generated in the control electrode of the second transistor and held in the capacitor is supplied to the control electrode of the first transistor.

Another exemplary embodiment of the present invention represents a first display reading apparatus (e.g., image display reading apparatus 40 in FIG. 5) having devices (e.g., organic EL device 101 in FIG. 11) to display or read images in units of pixels. Each pixel comprises a first transistor (e.g., transistor 122 or 123 in FIG. 11) to drive the device; a current supply circuit (e.g., signal line 152 in FIG. 11) for supplying, in a first mode (e.g., program mode), a current of a magnitude based on the value of the pixel displayed by the device; a second transistor (e.g., transistor 121 in FIG. 11) whose control electrode is connected to the control electrode of the first transistor to thereby constitute a current mirror circuit in combination with the first transistor, wherein the second transistor receives, in the first mode, the current supplied from the current supply circuit; a capacitor (e.g., capacitor 124 in FIG. 11) connected to the control electrode of the second transistor and holding, in the first mode, the voltage generated in the control electrode of the second transistor in a state where the current is supplied from the current supply circuit; first switches (e.g., switches SW11 to SW14 in FIG. 11) changed when enabling the device to receive the light; a second switch (e.g., switch SW23 in FIG. 11) for connecting, in a second mode (e.g., light emitting mode), the device to the first transistor in a state where the voltage generated in the control electrode of the second transistor and held in the capacitor is supplied to the control electrode of the first transistor; a third switch (e.g., switch SW25 in FIG. 11) changed for holding, in the capacitor, the voltage generated in the control electrode of the first transistor in a state where the current to flow in the device is supplied in a third mode (e.g., light receiving mode); and a fourth switch (e.g., switch SW21 in FIG. 11) for outputting, in a fourth mode (e.g., read mode), the current to flow in the second transistor in a state where the voltage generated in the control electrode of the first transistor and held in the capacitor is supplied to the control electrode of the second transistor.

This display reading apparatus is capable of executing, in the first mode, a light emitting current program to activate the device for emission of light; displaying, in the second mode, an image by activating the device to emit light; executing, in the third mode, a program of the received light current generated on the basis of the light received by the device; and reading the image, in the fourth mode, by reading out the received light current.

In this display reading apparatus, the device may consist of a light emitting device (e.g., organic EL device 201 in FIG. 16) to emit light in the second mode, and a light receiving device (e.g., organic EL device 202 in FIG. 16) to receive the light in the third mode. And the pixel may further comprise an amplifier circuit (e.g., transistors 144 and 145 in FIG. 16) to amplify the current generated by the light receiving device.

A further exemplary embodiment of the present invention represents a second display reading apparatus (e.g., image display reading apparatus 40 in FIG. 5) having luminescent devices (e.g., organic EL device 101 in FIG. 11) to display or read images in units of pixels. Each pixel comprises a first transistor (e.g., transistor 123 in FIG. 11) to drive the device; a second transistor (e.g., transistor 121 in FIG. 11) whose control electrode (e.g., gate) is connected to the control electrode of the first transistor to thereby constitute a current mirror circuit in combination with the first transistor; a capacitor (e.g., capacitor 124 in FIG. 11) connected to the control electrode of the first transistor and the control electrode of the second transistor; a first switch (e.g., switch SW22 in FIG. 11) for connecting, in a first mode (e.g., program mode), the output electrode of the second transistor to the control electrode in such a manner that the voltage generated in the control electrode of the second transistor is held in the capacitor when a current of a magnitude based on the value of the pixel has been supplied; a second switch (e.g., switch SW24 in FIG. 11) for connecting, in a second mode (e.g., light receiving mode), the output electrode of the first transistor to the control electrode in such a manner that the voltage generated in the control electrode of the first transistor is held in the capacitor when the current has been supplied from the device; and third switches (e.g., switches SW11 to SW14 in FIG. 11) for selectively changing the connection of the device to the first transistor in the first and second modes.

Hereinafter a detailed description will be given on some preferred embodiments of the present invention with reference to the accompanying drawings.

Figure 5:
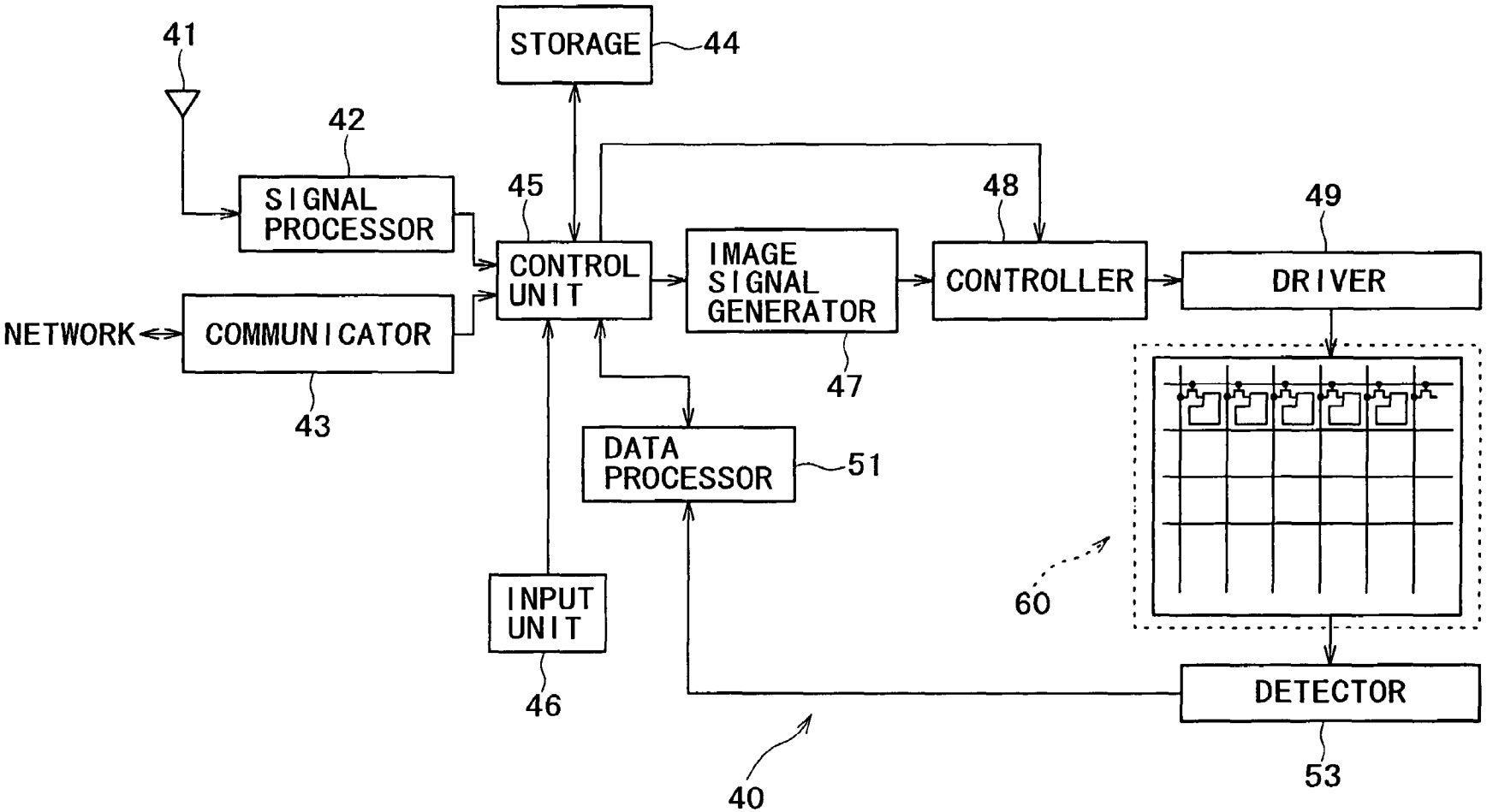
FIG. 5 is a block diagram showing a structural example of an image display reading apparatus where the present invention is applied.

FIG. 5 is a block diagram showing a structural example of an image display reading apparatus where the present invention is applied. A control unit 45 controls the entire operation of the image display reading apparatus 40 in accordance with a control program stored in an unshown ROM (read only memory), a storage 44 or the like, and executes various processes in response to user's instructions from an input unit 46 comprising a remote controller and so forth, such as displaying video images of a TV program on a desired channel, or accessing a desired site and displaying a picture thereof.

Under control of the control unit 45, a signal processor 42 modulates and acquires a signal of a desired channel out of TV broadcast waves being received via an antenna 41, and then outputs the broadcast program data of that channel to the control unit 45. A communicator 43 communicates with various external apparatus through cable or radio via a network such as the Internet, and outputs the acquired data to the control unit 45.

The storage 44 comprises a hard disk or the like, and stores various data therein, such as data of TV programs, data acquired by the communicator 43, and so forth.

An image signal generator 47 generates an image signal for displaying the image that corresponds to the data supplied from the control unit 45, and then outputs the generated image signal to a controller 48 which controls the driving of a display unit 60.

The controller 48 controls the driving of a driver 49 which controls the voltage applied to a gate electrode of a TFT disposed in each pixel of the display unit 60.

The driver 49 controls the voltage applied to the electrode of a TFT which constitutes a switching transistor in the circuit to drive the device (e.g., organic EL device) constituting each pixel of the display unit 60. Further, the driver 49 contains, therein, an unshown current source which generates a current required for execution of a current program and supplies the generated current to the circuit for driving each device.

A detector 53 has an unshown detection circuit therein for detecting the current generated on the basis of the light received by each pixel of the display unit 60, and outputs a predetermined signal, which is based on the detected current, to a data processor 51. The data processor 51 executes an image reading process in accordance with the signal supplied from the detector 53.

Figure 6A:
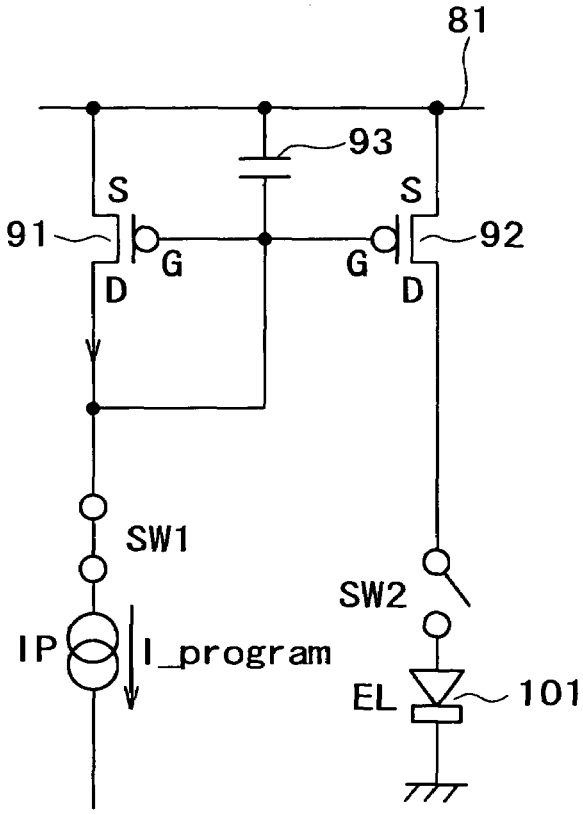
FIGS. 6A and 6B are circuit diagrams each showing a structural example of a circuit to drive the device in a display unit of FIG. 5.
Figure 6B:
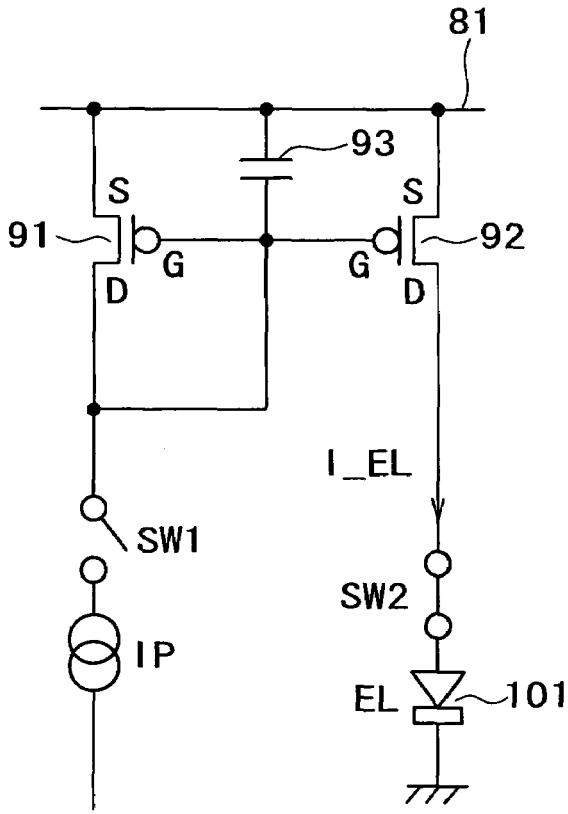

FIGS. 6A and 6B show a structural example of the circuit to drive the pixel constituting the display unit 60. In this circuit, source terminals of transistors 91 and 92 consisting of TFTs are connected to a source line 81. A capacitor 93 is connected at one end thereof to gate terminals of the transistors 91 and 92, while being connected at the other end thereof to a drain terminal of the transistor 91. A constant current source IP for generating a current, which is to be programmed, is connected via a switch SW1 to a drain terminal of the transistor 91, and an organic EL device 101 is connected via a switch SW2 to a drain terminal of the transistor 92.

In this circuit, the gates of the transistors 91 and 92 are connected mutually and are further connected to the drain of the transistor 91, thereby constituting a current mirror circuit.

When a current program is executed in this circuit, as shown in FIG. 6A, the switch SW1 is set to ON (closed) while the switch SW2 is set to OFF (open), and a current I_program to be programmed is supplied from the constant current source IP.

Consequently, the current I_program flows between the source terminal and the drain terminal of the transistor 91, whereby a gate voltage corresponding to the current I_program is generated at the gate terminal of the transistor 91. Then the gate voltage thus generated is charged in the capacitor 93. The current program is executed in this manner.

When the organic EL device 101 is to be activated for emission of light by the current programmed as shown in FIG. 6A, the switch SW1 is set to OFF while the switch SW2 is set to ON, as shown in FIG. 6B. Consequently, the constant current source IP is disconnected from the circuit, so that the voltage charged in the capacitor 93 is applied to the gate terminal of the transistor 92, and a current I_EL corresponding to this voltage flows between the source terminal and the drain terminal of the transistor 92. As a result, the current I_EL flows in the organic EL device 101 to thereby activate the device 101 for emission of light.

Supposing now that a source-gate voltage Vgs is applied to the gate terminal of a TFT (transistor), a current Id flowing between its source terminal and drain terminal is expressed as Eq. (1) given below.

$$Id=(1/2)\cdot\mu C_{ox}\cdot(W/L)\cdot(Vgs-Vth)^2 \quad (1)$$

In the above equation, μ denotes the mobility; $C_{ox}$ denotes the capacitance of a gate oxide film; W and L denote the channel width and the channel length respectively; and Vth denotes the threshold voltage. The respective values are determined by the characteristics of the TFT (transistor).

Assume here that, in the circuit of FIGS. 6A and 6B, the values of μ, $C_{ox}$, L and Vth in the transistor 91 are equal to those in the transistor 92, and also that the transistor 91 has a channel width W1, and the transistor 92 has a channel width W2. In this case, the voltages (Vgs) applied to the gate terminals of the transistors 91 and 92 are approximately equal to each other. Therefore, it is possible to calculate, according to Eq. (1), the current (=I_program) flowing between the source terminal and the drain terminal of the transistor 91, and the current (=I_EL) flowing between the source terminal and the drain terminal of the transistor 92. Then the current mirror ratio thereof can be obtained according to Eq. (2).

$$I_EL/I_\text{program}=W2/W1 \quad (2)$$

For example, when the value of the channel width W2 is ten times the value of the channel width W1, then the current I_program to be programmed by the current source IP may be ten times the current I_EL which flows in the organic EL device 101. In other words, due to the current mirror ratio of the transistors 91 and 92, it becomes possible to supply the current I_EL, which is one-tenth of the current I_program, to the organic EL device 101.

Consequently, even in a case where a minute current flows in the organic EL device 101 for activating the pixel for emission of light at a low luminance, the current to be programmed can be ten times the current to flow in the organic EL device 101, whereby the time required for generating the voltage to be charged in the capacitor 93 can be shortened to one-tenth. As a result, it becomes possible to increase the display speed in the display unit. Thus, the image display speed can be raised by controlling the driving of the organic EL device through the current mirror circuit. Further, any harmful influence derived from noise or the like is reducible since the magnitude of the current is great.

In FIGS. 6A and 6B, although an explanation has been given on one case of activating the organic EL device for emission of light by a flow of a current therein, it is also possible in the organic EL device to generate a current corresponding to the received light, by inverting the polarity of the anode and cathode thereof. The image can be read by detecting the generated current in the detector 53 of FIG. 5.

Figure 7A:
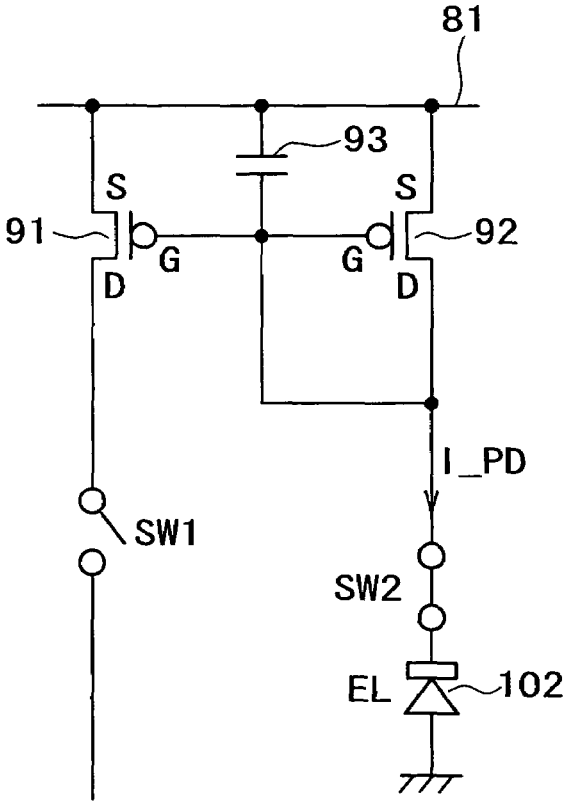
FIGS. 7A and 7B are circuit diagrams each showing a structural example of another circuit to drive the device in the display unit of FIG. 5.
Figure 7B:
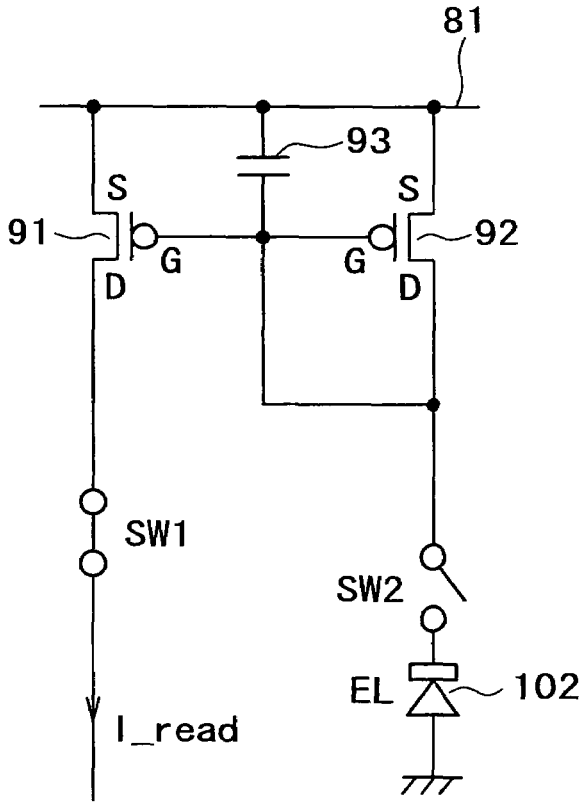

FIGS. 7A and 7B show exemplary circuits for driving, in the above case, each pixel that constitutes the display unit 60. In each circuit, source terminals of transistors 91 and 92 consisting of TFTs are connected to a source line 81. A capacitor 93 is connected at its one end to the source line 81, while being connected at its other end to gate terminals of the transistors 91 and 92 and further to a drain terminal of the transistor 92. The drain terminal of the transistor 91 is connected via a switch SW1 to an unshown detection circuit, and an organic EL device 102 is connected via a switch SW2 to the drain terminal of the transistor 92. In the organic EL device 102, its anode and cathode are inverse to those of the organic EL device 101 in FIGS. 6A and 6B. (The organic EL device 102 is one that utilizes a light receiving function out of the organic EL device having both a light emitting function and a light receiving function.)

In this circuit also, as in the foregoing case of FIGS. 6A and 6B, the gates of the transistors 91 and 92 are connected mutually to, thereby, form a current mirror circuit. In this case, however, the respective gates are not connected to the drain of the transistor 91, but to the drain of the transistor 92.

When the light is to be received by the organic EL device in this circuit, as shown in FIG. 7A, the switch SW1 is set to OFF while the switch SW2 is set to ON, whereby the light is irradiated to the organic EL device 102.

Consequently, a current I_PD corresponding to the intensity (luminance) of the received light is generated in the organic EL device 102, so that the current I_PD flows between the source terminal and the drain terminal of the transistor 92, and then a gate voltage corresponding to the current I_PD is generated at the gate terminal of the transistor 92. Thereafter the gate voltage thus generated is charged in the capacitor 93. In this manner, the current corresponding to the received light is programmed.

When the current thus programmed as in FIG. 7A is to be read out by the detection circuit in the detector 53, the switch SW1 is set to ON while the switch SW2 is set to OFF, as shown in FIG. 7B. Consequently, the organic EL device 102 is disconnected from the circuit, and the voltage charged in the capacitor 93 is applied to the gate terminal of the transistor 91, so that a current I_read corresponding to this voltage flows between the source terminal and the drain terminal of the transistor 91. This current I_read is read out by the detection circuit via the switch SW1.

Similarly to the foregoing case of FIGS. 6A and 6B, a current mirror circuit is formed in FIGS. 7A and 7B also. Therefore, if the channel width W2 is numerically ten times the channel width W1 for example, the current I_read to be read out by the detection circuit can be rendered ten times the current I_PD generated by the organic EL device 102. Consequently, the minute current generated by the organic EL device 102 is amplified correspondingly to the current mirror ratio and then is read out, hence improving the SN ratio in the read mode. As a result, the reading precision is improved.

Thus, due to the structure of the current mirror circuit, the current for controlling the light emission of the organic EL device can be increased or the current generated by the organic EL device can be amplified, so that it becomes possible to reduce any harmful influence that may be derived from external disturbance, hence improving the image display precision or the read precision.

In the examples of FIGS. 6A and 6B and FIGS. 7A and 7B, the anode and the cathode of the organic EL device connected to the driving circuit are inverted so as to comply with both displaying and reading of the image. However, it is also possible to invert the anode and the cathode of the organic EL device by selectively changing the switches.

Figure 8:
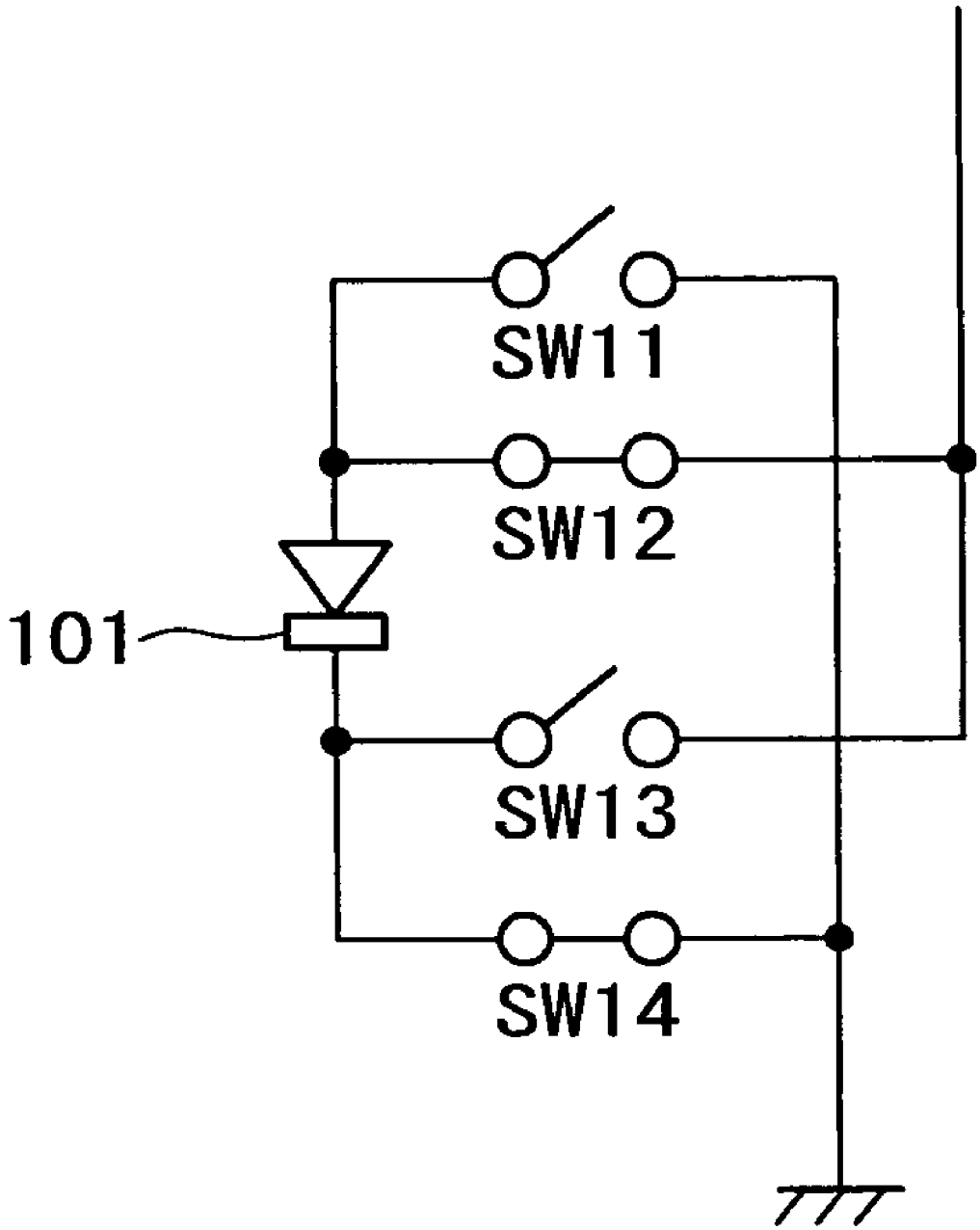
FIG. 8 is a circuit diagram showing a structural example of a circuit to invert the polarity of the device by setting the switches.

FIG. 8 is a diagram showing a structural example of a circuit to invert the anode and the cathode of the organic EL device by selectively changing the switches. When activating the organic EL device 101 for emission of light in this circuit, the switches SW11 to SW14 are so set as shown in FIG. 9.

That is, the switches SW11 and SW13 are set to OFF, while the switches SW12 and SW14 are set to ON. Consequently, the cathode of the organic EL device 101 is grounded via the switch SW14, so that the organic EL device 101 is activated to emit light in accordance with a flow of the current similarly to the organic EL device 101 in FIGS. 6A and 6B.

Meanwhile, in the case of enabling the organic EL device 101 to receive the light in this circuit, the switches SW11 to SW14 are so set as shown in FIG. 10.

That is, the switches SW11 and SW13 are set to ON, while the switches SW12 and SW14 are set to OFF. Consequently, the anode of the organic EL device 101 is grounded via the switch SW11, so that the organic EL device 101 causes a current flow in accordance with the received light similarly to the organic EL device 102 in FIGS. 7A and 7B.

Figure 11:
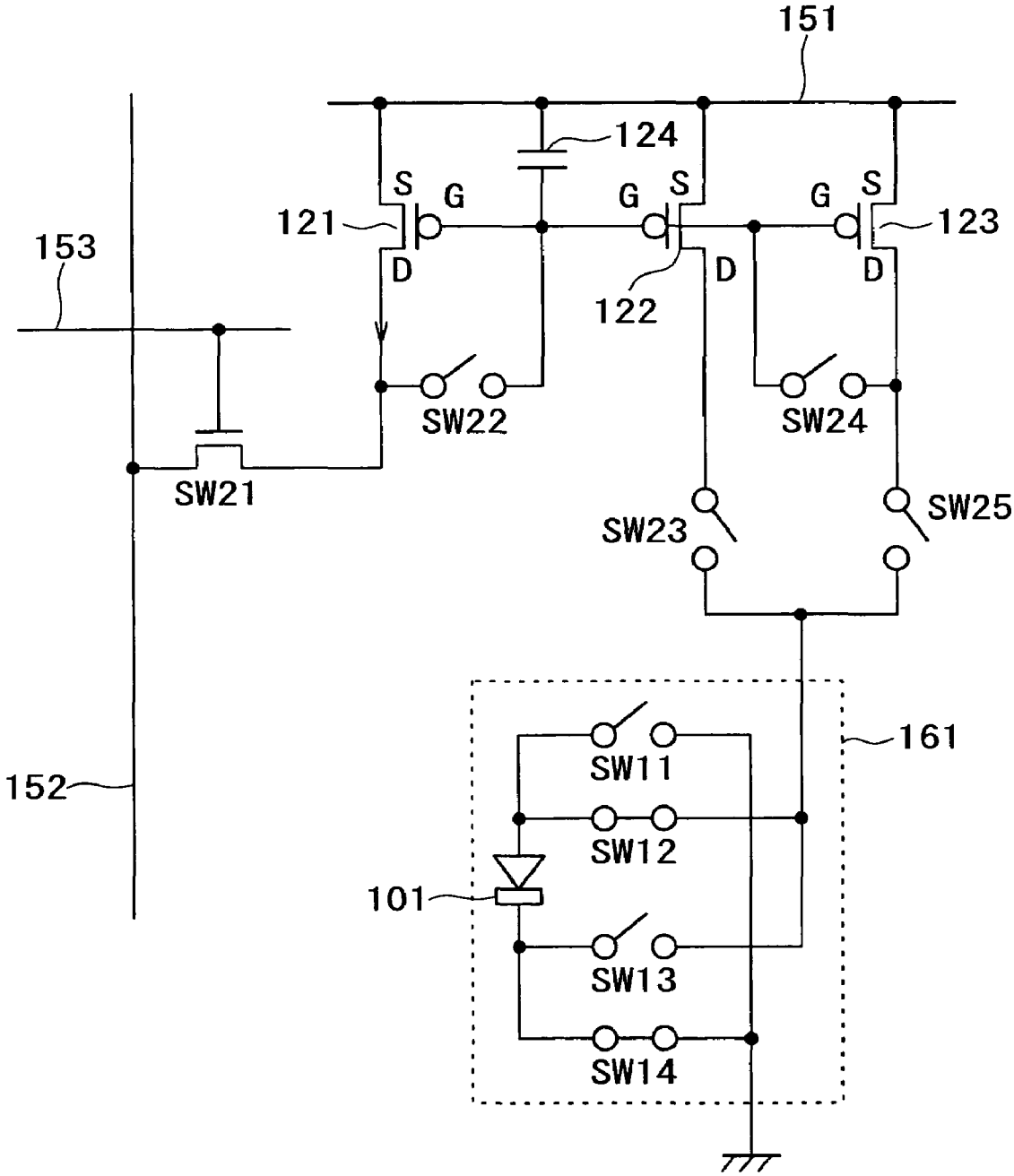
FIG. 11 is a circuit diagram showing another structural example of the circuit to drive the device in the display unit of FIG. 5.

FIG. 11 shows another example of a circuit for driving pixels that constitute the display unit 60. In this circuit, one organic EL device 101 executes both the displaying and reading of an image. Source terminals of transistors 121 to 123 each consisting of a TFT are connected to a source line 151. A capacitor 124 is connected at one end thereof to the source line 151 while being connected at the other end thereof to gate terminals of the transistors 121 to 123, and also to a drain terminal of the transistor 121 via a switch SW22, and further to a drain terminal of the transistor 123 via a switch SW24.

A switching transistor SW21 (hereinafter referred to as switch SW21) functioning as a switch is connected to the drain terminal of the transistor 121. The switch SW21 is so set as to be turned ON when a predetermined voltage is applied to a gate line 153. Each of the switches SW22 to SW25 may consist of a switching transistor, similarly to the switch SW21. A signal line 152 is connected to the left terminal (in FIG. 11) of the switch SW21. A current source (not shown) used for programming the current and a detection circuit (not shown) used for reading the current generated by the organic EL device 101 in accordance with the received light are connected to the signal line 152, wherein the connection of the current source and the detection circuit can be selectively changed as required.

The transistor 122 or 123 is connected to a circuit 161 via the switch SW23 or SW25. This circuit 161 is the same as the foregoing circuit described with reference to FIG. 8, and it inverts the polarity (anode and cathode) of the organic EL device 101 by changing the set states of the switches SW11 to SW14.

As mentioned above, this circuit is capable of causing a current flow in the organic EL device 101 to activate it for emission of light by changing the set states of the switches in the circuit 161 and displaying the image (in a display mode), and is further capable of reading the image (in a read mode) by generating, in the organic EL device 101, a current which corresponds to the received light. In the display mode where the organic EL device 101 is activated for emission of light, the switches SW11 to SW14 in the circuit 161 are so set as shown in FIG. 9. In the read mode where the organic EL device 101 is enabled to receive the light, the switches SW11 to SW14 in the circuit 161 are so set as shown in FIG. 10.

In this circuit, the component transistors are so arranged that, in the display mode, a current mirror circuit is formed by the transistors 121 and 122; and in the read mode, a current mirror circuit is formed by the transistors 121 and 123.

When a current program is executed in the display mode in the circuit of FIG. 11, the switches SW21 to SW25 are so set as shown in FIG. 12. That is, the switches SW21 and SW22 are set to ON, while the switches SW23 to SW25 are set to OFF. A current I_program to be programmed is supplied to the signal line 152.

Consequently, the current I_program is supplied to the transistor 121 via the switch SW21, so that the current. I_program flows between the source terminal and the drain terminal of the transistor 121, and a gate voltage corresponding to the current I_program is generated at the gate terminal of the transistor 121. The gate voltage thus generated is charged in the capacitor 124. The current program is executed in this manner.

In the display mode where the organic EL device 101 is activated for emission of light by the programmed current, the switches SW21 to SW25 are so set as shown in FIG. 13. That is, the switches SW21 and SW22 are set to OFF (switch SW22 may be set to ON as well), while the switch SW23 is set to ON, and the switches SW24 and SW25 are set to OFF. Consequently, the signal line 152 is disconnected from the circuit, so that the voltage charged in the capacitor 124 is applied to the gate terminal of the transistor 122, and a current I_EL corresponding to this voltage flows between the source terminal and the drain terminal of the transistor 122. The current I_EL is supplied to the circuit 161 via the switch SW23, thereby activating the organic EL device 101 to emit light.

Similarly to the transistors 91 and 92 in FIGS. 6A and 6B, a current mirror circuit is formed by the transistors 121 and 122, so that the ratio of the current I_EL to the current I_program can be expressed as the ratio of the channel width W12 of the transistor 122 to the channel width W11 of the transistor 121, as in the aforementioned case of FIGS. 6A and 6B.

In the circuit of FIG. 11, in the read mode where the organic EL device 101 is enabled to receive the light and to generate a current corresponding to the received light, the switches SW21 to SW25 are so set as shown in FIG. 14. That is, the switches SW21 to SW23 are set to OFF, while the switches SW24 and SW25 are set to ON, whereby the organic EL device 101 is enabled to receive the light.

Consequently, the organic EL device 101 generates a current I_PD corresponding to the intensity (luminance) of the received light. The current I_PD is supplied to the transistor 123 via the switch SW25, so that the current I_PD flows between the source terminal and the drain terminal of the transistor 123, and a gate voltage corresponding to the current I_PD is generated at the gate terminal of the transistor 123. Then the gate voltage thus generated is charged in the capacitor 124. The current corresponding to the light received by the organic EL device 101 is programmed in this manner.

When reading out the programmed current by the detection circuit in the read mode, the switches SW21 to SW25 are so set as shown in FIG. 15. That is, the switches SW21 and SW22 are set to ON, while the switch SW23 is set to OFF, and the switches SW24 and SW25 are set to ON. Consequently, the voltage charged in the capacitor 124 is applied to the gate terminal of the transistor 121, and a current I_read corresponding to this voltage flows between the source terminal and the drain terminal of the transistor 121. The current I_read is supplied to the signal line 152 via the switch SW21 and then is read out by the detection circuit.

Thus, due to insertion of the switch SW22 between the gate and source of the transistor 121 and also due to insertion of the switch SW24 between the gate and source of the transistor 123, the current mirror circuit is rendered usable bidirectionally (with its input and output inverted).

Similarly to the transistors 91 and 92 in FIGS. 7A and 7B, a current mirror circuit is formed by the transistors 121 and 123, so that the ratio of the current I_PD to the current I_read can be expressed as the ratio of the channel width W13 of the transistor 123 to the channel width W11 of the transistor 121, as in the aforementioned case of FIGS. 7A and 7B.

For example, if the circuit of FIG. 11 is so formed as to obtain W11:W12=20:1, even when the current I_EL for activating the organic EL device 101 to emit light is as minute as 100 nA, the current I_program to be generated from the current source in executing the current program becomes 2 μA (=100 nA×20), so that control of the minute current is no longer needed to eventually simplify the structure of, e.g., the driver 49 in FIG. 5. Further, as described, the time required for charging the voltage in the capacitor can be shortened.

Moreover, in another case of forming the circuit to obtain W11:W13=100:1 for example, even when the current I_PD generated by the organic EL device 101 is as minute as 5 nA, the read current I_read becomes 0.5 μA (=5 nA×100), so that detection of the minute current is no longer needed (i.e., a greater current can be detected), hence simplifying the structure of, e.g., the detector 53 in FIG. 5.

Since the driving circuit for the organic EL device is constituted of a current mirror circuit as mentioned, firstly, high-quality image display is rendered possible. Secondly, reading is achievable more simply and at lower cost. Thirdly, an apparatus capable of both displaying and reading an image can be realized at lower cost with a simpler structure. And fourthly, due to the configuration where the polarity of the organic EL device is inverted by means of the circuit 161, an image can be both displayed and read by the use of the same device, hence attaining a further curtailment of the cost that is derived from common use of the component parts. Furthermore, since the device can be down-sized, it is adapted for a mobile telephone, a personal computer or the like which can perform both display (output) and read (input) with one display unit (interface).

Shown in FIG. 11 is an exemplary circuit for both displaying and reading an image by a single organic EL device 101. However, it is a matter of course that an exclusive organic EL device may be employed for each of displaying and reading an image, respectively.

Figure 16:
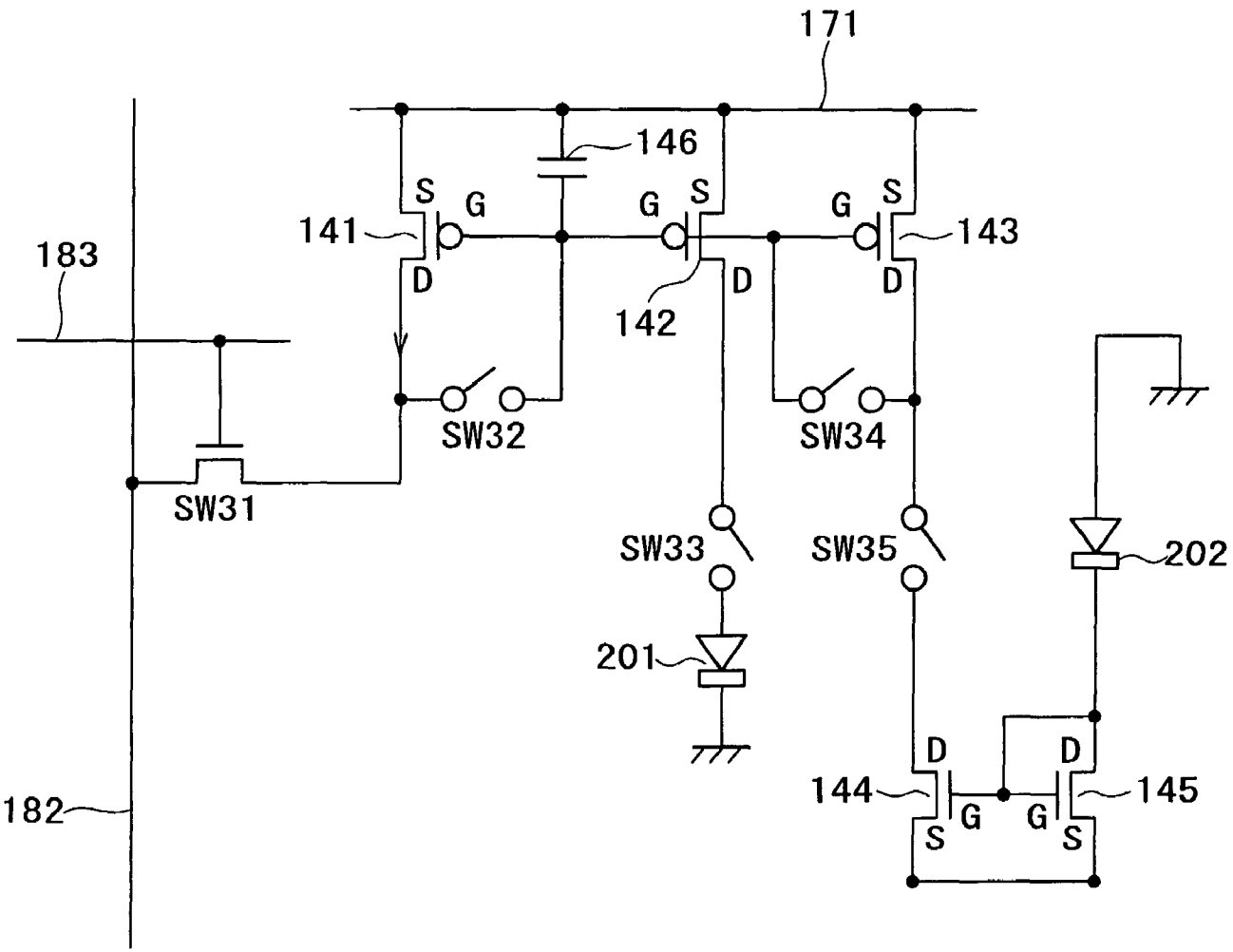
FIG. 16 is a circuit diagram showing another structural example of the circuit to drive the device in the display unit of FIG. 5.

FIG. 16 shows a further exemplary circuit to drive a pixel constituting a display unit 60. In this circuit, an image is displayed by an organic EL device 201, and the image is read by another organic EL device 202.

Source terminals of transistors 141 to 143 each consisting of a TFT are connected to a source line 171. A capacitor 146 is connected at one end thereof to the source line 171, while being connected at the other end thereof to gate terminals of the transistors 141 to 143 and further to a drain terminal of the transistor 141 via a switch SW32 and also to a drain terminal of the transistor 143 via a switch SW34.

A switching transistor SW31 (hereinafter referred to as switch SW31) is connected to the drain terminal of the transistor 141. The switch SW31 is so set as to be turned ON when a predetermined voltage is applied to a gate line 183. Similarly to the switch SW31, each of the switches SW32 to SW35 may consist of a switching transistor as well. A signal line 182 is connected to the left terminal (in FIG. 16) of the switch SW31. And a constant current source (not shown) used for programming the current and a detection circuit (not shown) used for reading the current generated by the organic EL device 202 in accordance with the received light are connected to the signal line 182, wherein the connection of the constant current source and the detection circuit can be selectively changed as required.

The organic EL device 201 is connected to the drain terminal of the transistor 142 via the switch SW33, and the transistors 144 and 145 and the organic EL device 202 are connected to the drain terminal of the transistor 143 via the switch SW35. The organic EL device 201 and the organic EL device 202 are so connected that the polarities of the respective anodes and cathodes become mutually inverse, and the organic EL device 201 emits light in accordance with the current caused to flow therein, while the organic EL device 202 generates a current corresponding to the received light. In the circuit of FIG. 16 also, a display mode and a read mode exist as in the aforementioned case of FIG. 11.

The respective gates of the transistors 144 and 145 are connected mutually, and the gate and drain of the transistor 145 are connected to thereby constitute a current mirror circuit, wherein, when a current corresponding to the received light has been generated by the organic EL device 202, the current is amplified and then is supplied to the transistor 143 via the switch SW35.

Further, this circuit is so formed that, in the display mode, the switch SW32 is turned ON so that the transistors 141 and 142 constitute a current mirror circuit; and in the read mode, the switch SW34 is turned ON so that the transistors 141 and 143 constitute a current mirror circuit.

When a current program is executed in the display mode in the circuit of FIG. 16, the switches SW31 to SW35 are so set as shown in FIG. 17. That is, the switches SW31 and SW32 are set to ON, while the switches SW33 to SW35 are set to OFF. And a current I_program to be programmed is supplied to the signal line 182.

Consequently, the current I_program flows between the source terminal and the drain terminal of the transistor 141, and a gate voltage corresponding to the current I_program is generated at the gate terminal of the transistor 141. The gate voltage thus generated is charged in the capacitor 146. The current program is executed in this manner.

In the display mode where the organic EL device 201 is activated for emission of light by the programmed current, the switches SW31 to SW35 are so set as shown in FIG. 18. That is, the switches SW31 and SW32 are set to OFF (switch SW32 may be set to ON as well), while the switch SW33 is set to ON, and the switches SW34 and SW35 are set to OFF. Consequently, the signal line 182 is disconnected from the circuit, so that the voltage charged in the capacitor 146 is applied to the gate terminal of the transistor 142, and a current I_EL corresponding to this voltage is caused to flow between the source terminal and the drain terminal of the transistor 142. And the current I_EL is supplied to the organic EL device 201 via the switch SW33, thereby activating the organic EL device 201 to emit light.

Similarly to the transistors 91 and 92 in FIGS. 6A and 6B, a current mirror circuit is formed by the transistors 141 and 142, so that the ratio of the current I_EL to the current I_program can be expressed as the ratio of the channel width W22 of the transistor 142 to the channel width W21 of the transistor 141, as in the aforementioned case of FIGS. 6A and 6B.

In the circuit of FIG. 16, when enabling the organic EL device 202 to receive the light and to generate a current corresponding to the received light, the switches SW31 to SW35 are so set as shown in FIG. 19. That is, the switches SW31 to SW33 are set to OFF, while the switches SW34 and SW35 are set to ON, whereby the organic EL device 202 is enabled to receive the light.

Consequently, the organic EL device 202 generates a current I_PD corresponding to the intensity (luminance) of the received light. The current I_PD is supplied to the transistor 145, so that the current I_PD flows between the source terminal and the drain terminal of the transistor 145, and a gate voltage corresponding to the current I_PD is generated at the gate terminal of the transistor 145. The gate voltage thus generated is supplied also to the gate terminal of the transistor 144, so that a current I_PDA corresponding to the gate voltage flows between the source terminal and the drain terminal of the transistor 144.

As described, the transistors 144 and 145 constitute a current mirror circuit, wherein the current flowing between the source terminal and the drain terminal of the transistor 144 is the one generated in the organic EL device 202 and amplified by the current mirror circuit. The amplified current I_PDA is supplied to the transistor 143 via the switch SW35, so that the current I_PDA flows between the source terminal and the drain terminal of the transistor 143, and a gate voltage corresponding to the current I_PDA is generated at the gate terminal of the transistor 143. The gate voltage thus generated is charged in the capacitor 146. The current corresponding to the light received by the organic EL device 202 is programmed in this manner.

When reading out the programmed current by an unshown detection circuit in the read mode, the switches SW31 to SW35 are so set as shown in FIG. 20. That is, the switches SW31 and SW32 are set to ON, while the switch SW33 is set to OFF, and the switches SW34 and SW35 are set to ON. Consequently, the voltage charged in the capacitor 146 is applied to the gate terminal of the transistor 141, and a current I_read corresponding to this voltage flows between the source terminal and the drain terminal of the transistor 141. The current I_read is supplied to the signal line 182 via the switch SW31 and then is read out by the detection circuit.

Similarly to the transistors 91 and 92 in FIGS. 7A and 7B, a current mirror circuit is formed by the transistors 141 and 143, so that the ratio of the current I_PDA to the current I_read can be expressed as the ratio of the channel width W23 of the transistor 143 to the channel width W21 of the transistor 141, as in the aforementioned case of FIGS. 7A and 7B. Further, since a current mirror circuit is formed by the transistors 144 and 145, the ratio of the current I_PD to the current I_PDA can be expressed as the ratio of the channel width W25 of the transistor 145 to the channel width W24 of the transistor 144.

For example, if the circuit of FIG. 16 is so formed as to obtain W21:W22=20:1, even when the current I_EL for activating the organic EL device 201 to emit light is minute, the current I_program to be generated from the current source in executing the current program becomes twenty times the current I_EL.

Moreover, in another case of forming the circuit to obtain W21:W23=100:1 and W24:W25=10:1 for example, the current I_PD generated by the organic EL device 202 is amplified ten times to become I_PDA, which is further amplified one hundred times to become I_read. Therefore, if the current generated by the organic EL device 202 is as minute as 5 nA for example, the current I_read to be read is 5 μA (=5 nA×10×100), so that detection of the minute current is no longer needed.

Thus, since the circuit for driving the organic EL devices is formed by means of a current mirror, it becomes possible, as in the aforementioned case of FIG. 11, to display a high-quality image and to read the high-quality image with a simplified structure. Differing from the case of FIG. 11, the organic EL device 201 used for image display (light emission) and the organic EL device 202 used for image read (light reception) are provided separately, and the current corresponding to the received light is further amplified by the current mirror consisting of the transistors 144 and 145, whereby it is rendered possible to form the circuit using the organic EL device 202 which is higher in photo-sensitivity than the organic EL device 201, hence improving the image reading precision.

Although the explanation has been given hereinabove with regard to some examples of using organic EL devices as components to constitute pixels, such organic EL devices may be replaced with those having similar characteristics. The essential point resides in that the requirements can be satisfied if each device has both a light emitting function and a light receiving function. It is a matter of course that, when image display and light reception are to be performed by exclusive devices respectively, any device having merely an individual function may be employed as well.

What is claimed is:

1. A display reading apparatus including devices to display or read images in units of pixels, each pixel comprising:

a first transistor to drive the relevant device;

a current supply circuit for supplying, in a first mode, a current of a magnitude based on the value of the pixel displayed by said device;

a second transistor whose control electrode is connected to the control electrode of said first transistor to thereby constitute a current mirror circuit in combination with said first transistor, wherein said second transistor receives, in the first mode, the current supplied from said current supply circuit;

a capacitor connected to the control electrode of said second transistor and holding, in the first mode, the voltage generated in the control electrode of said second transistor in a state where the current supplied from said current supply circuit is received;

a first switch changed when enabling said device to receive the light;

a second switch for connecting, in a second mode, the device to said first transistor in a state where the voltage generated in the control electrode of said second transistor and held in said capacitor is supplied to the control electrode of said first transistor;

a third switch changed in a third mode for holding, in said capacitor, the voltage generated in the control electrode of said first transistor in a state where the current to flow in said device is supplied; and a fourth switch for outputting, in a fourth mode, the current to flow in said second transistor in a state where the voltage generated in the control electrode of said first transistor and held in said capacitor is supplied to the control electrode of said second transistor.

2. The display reading apparatus according to claim 1, wherein:

in the first mode, a light emitting current program is executed to activate said device for emission of light;

in the second mode, an image is displayed by activating said device for emission of light;

in the third mode, a received light current program is executed on the basis of the light received by said device; and in the fourth mode, the current based on the received light is read out to thereby read the image.

3. The display reading apparatus according to claim 2, wherein said device consists of a light emitting device to emit light in the second mode, and a light receiving device to receive the light in the third mode; and each pixel further comprises an amplifier circuit to amplify the current generated by said light receiving device.

* * * * *